US005971816A

United States Patent [19]

Chaillot

[11] Patent Number: 5,971,816

[45] Date of Patent: Oct. 26, 1999

[54] MINIATURE ELECTRICAL CONTACT WITH FOLDED DOUBLE WALL CAGE SECTION

[75] Inventor: Georges Chaillot, Nogent le Roi, France

[73] Assignee: Framatome Connectors International, Courbevoie, France

[21] Appl. No.: 09/098,995

[22] Filed: Jun. 17, 1998

[30] Foreign Application Priority Data

Jun. 24, 1997 [FR] France ..... 97/07981

[51] Int. Cl.[6] ..... H01R 11/22

[52] U.S. Cl. ..... 439/852

[58] Field of Search ..... 439/850, 851, 439/852, 853, 854

[56] References Cited

U.S. PATENT DOCUMENTS

| | | | |
|---|---|---|---|
| 4,798,545 | 1/1989 | Roy et al. | 439/677 |
| 5,188,545 | 2/1993 | Hass et al. | 439/851 |

FOREIGN PATENT DOCUMENTS

| | | |
|---|---|---|
| 0196367 A1 | 10/1986 | European Pat. Off. . |
| 0310487B1 | 4/1989 | European Pat. Off. . |
| 0547396 A2 | 6/1993 | European Pat. Off. . |
| 0618644 A2 | 10/1994 | European Pat. Off. . |
| 2721758 | 12/1995 | France . |
| WO 95/11532 | 4/1995 | WIPO . |

*Primary Examiner*—Neil Abrams
*Assistant Examiner*—Javaid Nasri
*Attorney, Agent, or Firm*—Perman & Green, LLP

[57] ABSTRACT

Contact terminal (1) provided with a rear part (2), for connection to an electrical wire (3), and with a front part for receiving a complementary pin contact (4), the contact terminal being provided with at least one cantilevered resilient contacting blade (5, 6), for which the front part is formed into a cage having a bottom (7), a first side (8) extended by a top (9) and a second side (10), the top, a single flank (11) being folded in order to follow, in succession, the internal faces of the top, of the first side and of the bottom, the folded flank carrying the resilient blade.

12 Claims, 3 Drawing Sheets

MINIATURE ELECTRICAL CONTACT WITH FOLDED DOUBLE WALL CAGE SECTION

The invention relates to a one-piece socket-type electrical contact terminal made of cut, folded and rolled sheet metal, intended for housing a complementary pin-type contact element. It relates more particularly to a socket contact terminal which includes a front body in the form of a cage, i.e. having an approximately parallelepipedal shape.

Contact terminals produced by cutting and folding a single sheet are already known. One embodiment of a one-piece contact terminal which is perfectly adapted to the field of motor-vehicle connection systems is described in European Patent EP 0,310,487 in the name of the Applicant.

The contact terminal according to Patent EP 0,310,487 includes a body in the form of a cage having a bottom adjoining two sides which are each provided with an internal flank, each carrying a resilient blade, and which are produced by flanks being folded down from top sections of the cage.

Moreover, small two-part contact terminals exist, for which an added cage surrounds a part for contact with a complementary pin contact. Document EP 0,196,367 gives an embodiment of such a terminal. However, these two-part terminals remain expensive to manufacture and require relatively lengthy operations for assembling the various pieces.

In the case of very small contacts, for example for receiving pin contacts of square cross-section with sides of 0.63 mm, as illustrated in document EP 0,547,396, and for keeping a one-piece construction, the geometry of the terminal according to document EP 0,310,487 cannot easily be retained as the rigidity of the cage must be increased at the junction between the bottom and the sides of the cage.

The invention is intended to produce a socket contact terminal which is particularly suited to producing a very small cross-section, while retaining a mono-bloc one-piece construction.

To do this, the invention relates mainly to a socket contact terminal provided with a rear part, for connection to an electrical wire, and with a front part in the form of a cage for receiving a complementary pin contact, the contact terminal being provided with at least one cantilevered resilient contacting blade, and the cage having a bottom, first and second sides, and a top, characterized in that a single flank is folded in order to follow, in succession, the internal faces of the top, of at least one of the sides and of the bottom, the folded flank carrying the said resilient contacting blade.

In a preferred embodiment of the invention, the single flank constitutes an extension of the top and is folded in such a way that it has, in succession, an upper slat, a lateral slat and a lower slat.

Advantageously, the upper slat and the lower slat may each be extended forwards by a resilient contacting blade.

Figure 1:
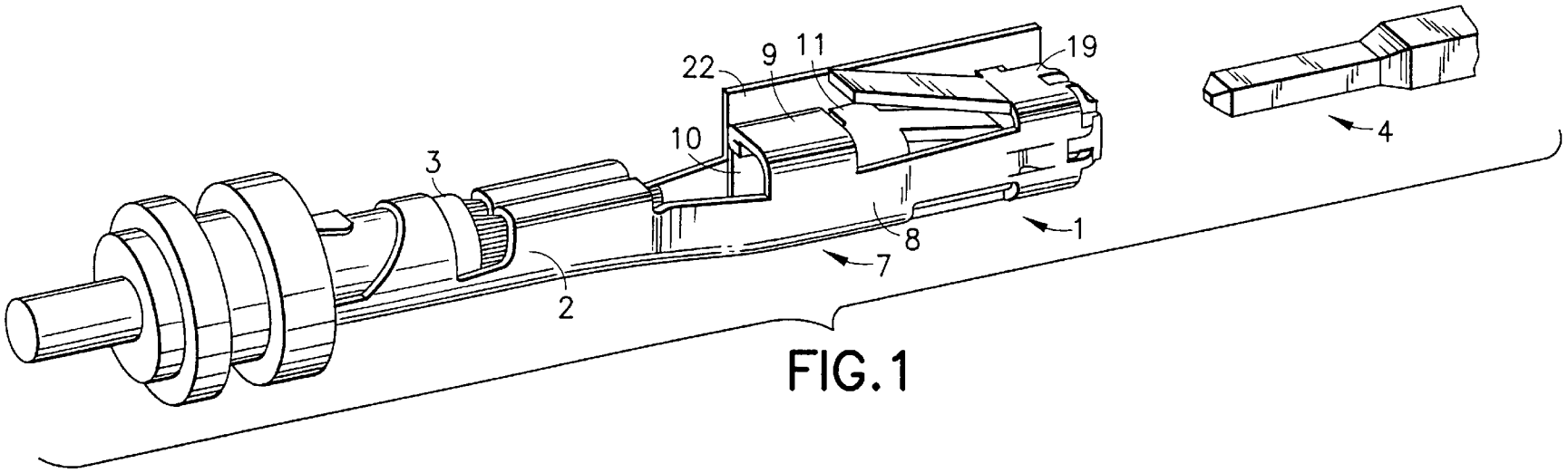
Figure 2:
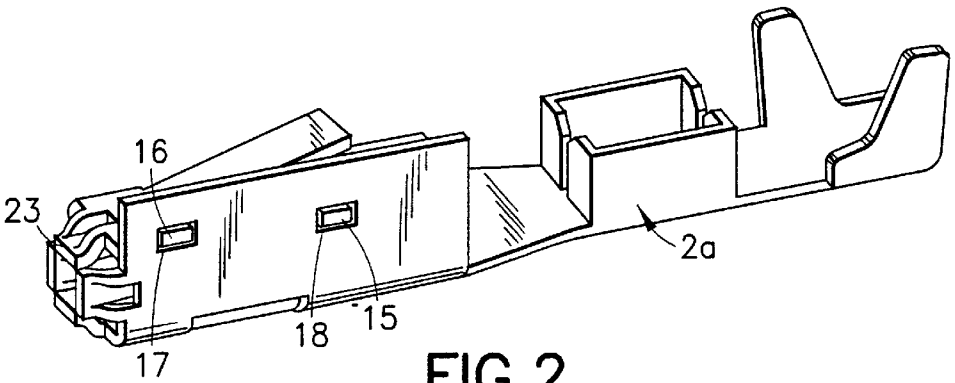
Figure 3:
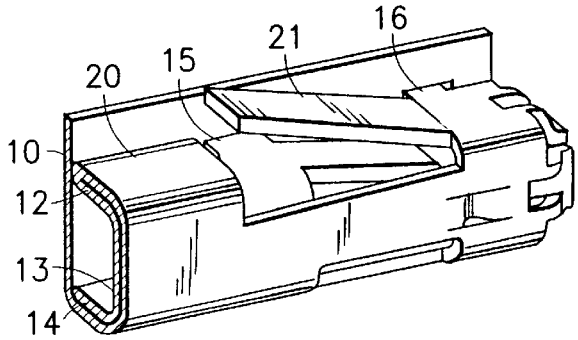
Figure 4:
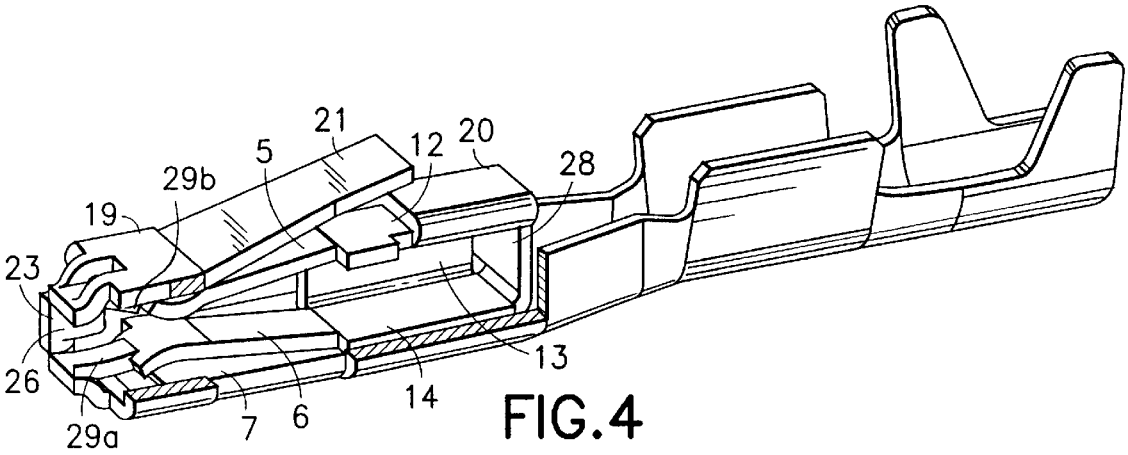
Figure 5:
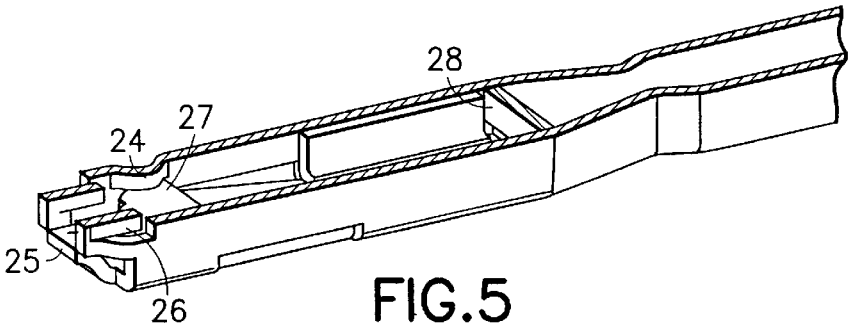
Figure 6:
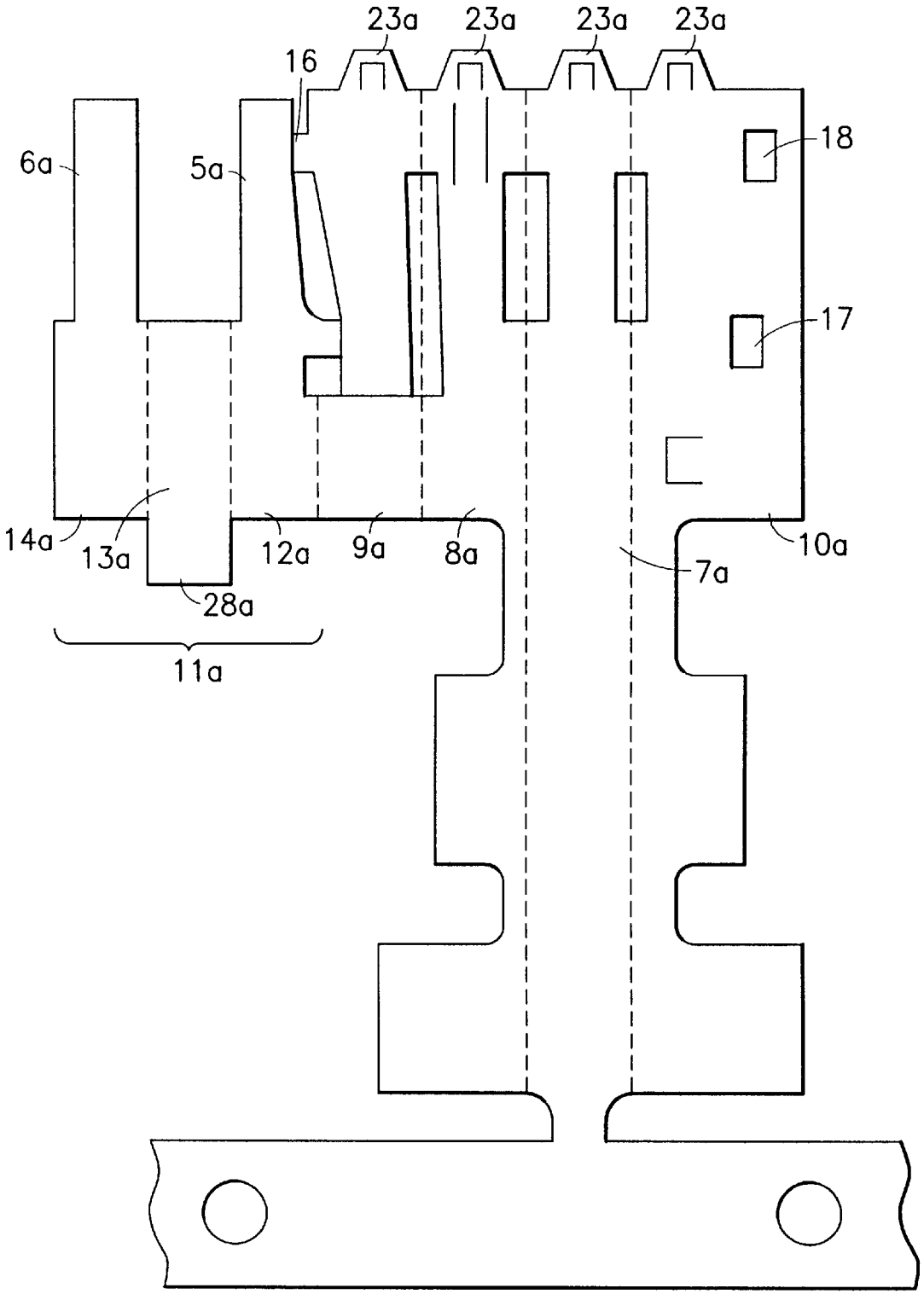

Other features and advantages of the invention will become more apparent on reading the description which follows, in conjunction with the drawings which illustrate:

in FIGS. 1 and 2, two perspective views of the contact terminal according to the invention, in FIG. 3, a perspective view, with a cross-section, of the cage of the contact terminal according to the invention, in FIG. 4, a perspective view, with one side of the cage removed, of the contact terminal according to the invention, in FIG. 5, a perspective view, with a longitudinal section in a horizontal plane, of the contact terminal according to the invention, and in FIG. 6, a view illustrating a cut sheet for producing the contact terminal according to the invention.

As may be seen in FIG. 1, the contact terminal 1 according to the invention is provided with a rear part 2 for connection to an electrical wire 3. Conventionally, this rear part may consist of flanges which can be crimped onto a stripped electrical wire and its insulation, or, as may be seen in FIG. 2, of a connection terminal 2*a* called an insulation-displacement terminal.

The front part of the terminal constitutes a part for receiving and contacting a complementary pin contact 4. To do this, the front part is in the form of a parallelepipedal cage, this cage having a bottom 7, a first side 8, a top 9 and a second side 10. This parallelepipedal cage is thus suitable for being housed in a cavity formed in the insulating part of a connector (not illustrated).

In order to produce the part for contacting with the corresponding pin contact 4, the contacting front part has one or two resilient blades 5 6 carried by a single flank 11 which is folded in order to follow, in succession, the internal faces of the top, of the first side and of the bottom. This configuration consisting of a single folded flank advantageously constitutes a double-walled cage which is thus stiffened on at least three sides of the cage.

The folded flank 11 thus has, in succession, an upper slat 12, a lateral slat 13 and a lower slat 14, thus forming the internal cage.

As may be particularly seen in FIG. 4, the folded flank carries resilient blades 5, 6 for contacting with the pin contact. These resilient blades consist of extensions of the folded flank towards the front of the cage and their free part has a projection which is inclined towards the interior of the cage.

In the optimum configuration of the contact terminal according to the invention, the contact terminal has two cantilevered resilient contacting blades 5 and 6 arranged symmetrically with respect to the axis of insertion of the pin contact and produced from, respectively, the upper slat 12 and the lower slat 14 of the folded flank. Obviously, it would be possible, while still remaining within the scope of the invention, to have an alternative form in which only one resilient blade would be produced while a projection for bearing on the pin contact would be produced on the opposite face. In this case, the single blade could, for example, be on the lateral slat 13 of the folded flank.

In order to close and stiffen the cage, cage-closing tabs 15, 16 fit into housings or openings 17, 18 made in the second side 10 of the cage. These tabs are located level with the junction between the top and the folded flank. In a preferred configuration, there are two tabs, a first tab 16 being located on the front of the cage and formed by an extension of the free lateral edge of a front part 19 of the top of the cage. This tab closes the cage and stiffens the front part for receiving the complementary pin contact. The second tab 15 is produced on the rear part of the cage. With an option that this tab might be formed by an extension of the free edge of the top, it was preferred to arrange this tab as an extension of the upper slat of the folded flank, the tab being contiguous with the base of the resilient blade 5, thereby not only stiffening the internal cage but also keeping the base of the resilient blade 5 in place.

One advantage of producing the top with a front part 19 and a rear part 20 which are separate, the folded flank and the top being connected at the rear part 19 of the top, is that it simplifies the cutting of a fastening catch 21, the latter being formed by bending a rearward extension of the front part of the top towards the outside of the cage. A construction in which the top is a one-part top with the catch replaced by a window for receiving a latch, as described in Patent EP 0,310,487 would, of course, be conceivable.

In the field of motor-vehicle connection systems, it is often desirable to polarize the contact, i.e. allow it to be inserted into its receiving cavity only in one orientation. To do this, the second side of the cage may have an edge 22 which projects vertically from the cage in order to form a polarizing key allowing polarization of the terminal.

The cage may be provided, at its end for inserting a complementary pin contact, with flaps 23 for guiding the insertion of the pin contact 4. These flaps, which may be seen in particular in FIGS. 2, 4 and 5, precisely locate the front of the cage in their receiving cavity and are provided for this with a straight end 25 defining a centring frame. In order to extend the guiding section of the pin contact, the flaps may advantageously be provided with flat extensions 26 parallel to the direction of insertion of the pin contact; these extensions may be produced by incisions in the sheet. FIG. 4 depicts an alternative embodiment in which certain of the extensions 29*a*, 29*b* form tabs for bearing on the resilient blades and for prestressing the latter.

The cantilevered resilient blades 5, 6 are formed by bending the extensions of the folded flank so that their free end faces the central axis of the cage. In order to balance the compressive force of the blades on the complementary pin contact and to provide its insertion passage between the resilient blades, one or more internal projections 24 may be formed by stamping the first and second sides of the cage. The blades then have their free end pressed against these projections by lateral tabs 27.

In order to close the rear of the cage, a flap 28 may be formed as a rear extension of one of the slats of the folded flank. This flap 28 helps to stiffen the cage.

A process for manufacturing the contact terminal according to the invention will now be described briefly. This manufacture starts with a metal sheet, illustrated diagrammatically in FIG. 6. As may be seen in FIG. 6, the sheet is firstly cut in order to produce the blanks for the various parts of the contact terminal. These blanks are referenced by adding an "a" suffix to the reference numbers of the corresponding finished parts. In particular, the flank 11*a*, which will become the single folded flank, includes the extensions 5*a*, 6*a* which will define the blades 5 and 6. Next, the steps of bending and folding the flanks start, firstly, by bending the blades and stamping/folding the various flaps 23*a*, 28*a*. Next, the single flank is folded through 180° at the point where it joins the part 9*a*, which will form the bottom of the cage. At this moment, the double wall of the cage is already formed. Next, the first side and the top of the cage may then be formed by an operation of shaping the cage by bending/rolling the sheet, while the second side of the cage is formed at the end by folding the lateral flank 10*a*.

I claim:

1. A socket contact terminal (1) provided with a rear part (2), for connection to an electrical wire (3), and with a front part in the form of a cage for receiving a complementary pin contact (4), the contact terminal being provided with at least one cantilevered resilient contacting blade (5, 6), and the cage having a bottom (7), first and second sides (8,10), and a top (9), characterized in that a single flank (11) is folded in order to follow, in succession, internal faces of the top, of at least one of the sides and of the bottom, wherein the flank is folded on an axis parallel to a longitudinal axis of the terminal such that portions of the cage including the top, bottom and at least one side are formed as a double wall, the folded flank carrying the said resilient contacting blade.

2. The contact terminal according to claim 1, characterized in that the single flank (11) constitutes an extension of the top and is folded in such a way that it has, in succession, an upper slat (12), a lateral slat (13) and a lower slat (14).

3. The contact terminal according to claim 2, characterized in that the upper slat and the lower slat are each extended forwards by the resilient contacting blade (5, 6).

4. The contact terminal according to claim 2, characterized in that the upper slat of the folded flank includes a cage-closing tab (15), this tab being contiguous with the base of the resilient contacting blade which extends the upper slat of the folded flank.

5. The contact terminal according to claim 1, characterized in that the cage includes cage-closing tabs (15, 16) level with a junction between the top and one of the said sides, these tabs fitting into housings (17, 18) made in the said side.

6. The contact terminal according to claim 1, characterized in that the top has a front part (19) and a rear part (20) which are separate, the folded flank and the top being connected at the rear part (20) of the top, the front part (19) of the top carrying a cage-closing tab (16) on its free lateral edge.

7. The contact terminal according to claim 6, characterized in that the front part of the top is extended rearwards by a fastening catch (21).

8. The contact terminal according to claim 1, characterized in that the second side of the cage has an edge (22) which projects vertically from the cage in order to form a polarizing key for the polarization of the terminal.

9. The contact terminal according to claim 1, characterized in that the cage is provided, at its end for insertion of the complementary pin contact, with flaps (23) for guiding the insertion of the pin contact (4).

10. A process for producing the contact terminal according to claim 1, characterized in that it comprises, in succession, a cutting step, a step of bending the resilient blades (5*a*, 6*a*), a step of stamping/folding the flaps, a step of folding a flank through 180° followed by a step of forming a cage by bending/rolling and a step of closing the cage by folding a flank 10*a*.

11. A socket contact terminal (1) provided with a rear part (2), for connection to an electrical wire (3), and with a front part in the form of a cage for receiving a complementary pin contact (4), the contact terminal being provided with at least one cantilevered resilient contacting blade (5, 6), and the cage having a bottom (7), first and second sides (8,10), and a top (9), characterized in that a single flank (11) is folded in order to follow, in succession, internal faces of the top, of at least one of the sides and of the bottom, the folded flank carrying the said resilient contacting blade, wherein at least one of the guiding flaps is extended rearwards by a tab (29*a*, 29*b*) for bearing on at least one of the resilient blades and for prestressing the at least one resilient blade.

12. A socket contact terminal (1) provided with a rear part (2), for connection to an electrical wire (3), and with a front part in the form of a cage for receiving a complementary pin contact (4), the contact terminal being provided with at least one cantilevered resilient contacting blade (5, 6), and the cage having a bottom (7), first and second sides (8,10), and a top (9), characterized in that a single flank (11) is folded in order to follow, in succession, internal faces of the top, of at least one of the sides and of the bottom, the folded flank carrying the said resilient contacting blade, wherein at least one of the first and second sides of the cage has an internal projection (24) for bearing on the resilient blades (5,6) and for prestressing the resilient blades.

* * * * *